US006538616B1

(12) United States Patent
Bedard

(10) Patent No.: US 6,538,616 B1
(45) Date of Patent: Mar. 25, 2003

(54) CUBIC ANTENNA

(75) Inventor: Fernand D. Bedard, Silver Spring, MD (US)

(73) Assignee: The United States of America as represented by the National Security Agency, Washington, DC (US)

( * ) Notice: Subject to any disclaimer, the term of this patent is extended or adjusted under 35 U.S.C. 154(b) by 0 days.

(21) Appl. No.: 10/022,672

(22) Filed: Dec. 18, 2001

(51) Int. Cl.[7] ..... H01Q 7/08

(52) U.S. Cl. ..... 343/788; 343/742; 343/867; 175/45; 342/459

(58) Field of Search ..... 343/741, 742, 343/787, 788, 866, 867; 175/45, 62; 342/459

(56) References Cited

U.S. PATENT DOCUMENTS

| | | | | |
|---|---|---|---|---|
| 3,953,799 A | | 4/1976 | Albee | |
| 4,186,749 A | * | 2/1980 | Fryer | 128/748 |
| 4,429,314 A | * | 1/1984 | Albright | 343/788 |
| 4,622,644 A | * | 11/1986 | Hansen | 364/559 |
| 5,357,253 A | | 10/1994 | Van Etten et al. | |
| 5,840,024 A | | 11/1998 | Taniguchi et al. | |
| 6,014,111 A | * | 1/2000 | Johannessen | 343/788 |
| 6,084,513 A | | 7/2000 | Stoffer | |
| 6,095,260 A | | 8/2000 | Mercer et al. | |

OTHER PUBLICATIONS

Richard C. Johnson, "Antenna Engineering Handbook," McGraw–Hill, Inc., New York, 1993, 1984, 1961, pp. 24–28.

* cited by examiner

*Primary Examiner*—Tho Phan
(74) *Attorney, Agent, or Firm*—Robert D. Morelli

(57) ABSTRACT

The present invention is an antenna with a cubic core. A first conductor is wound around the core's first axis. A first dielectric layer is placed around the first conductor. A first electrical shield is placed around the first dielectric layer. A second dielectric layer is placed around the first electrical shield. A second conductor is wound around the second dielectric layer in the core's second axis. A second electrical shield is placed around the third dielectric layer. A fourth dielectric layer is placed around the second electrical shield. A third conductor is wound around the fourth dielectric layer in the core's third plane. A fifth dielectric layer is placed around the third conductor. A third electrical shield is placed around the fifth dielectric layer. Each conductor is connected to an amplifier. Each amplifier is connected to an anti-aliasing filter. Each anti-aliasing filter is connected to an analog-to-digital converter. Each analog-to-digital converter is connected to a multiplexer.

13 Claims, 4 Drawing Sheets

CUBIC ANTENNA

FIELD OF THE INVENTION

The present invention relates, in general, to communications, radio wave antennas, and, in particular, to loop type antennas with plural loops.

BACKGROUND OF THE INVENTION

Antennas for capturing a radio wave are of two basic types: electric field antennas and magnetic field antennas. A fundamental parameter of each type, whether it is a single element or a configuration such as an array, is its sensitivity. A second concern is its frequency range of performance. A third consideration is the spatial pattern of its response to incoming radio waves.

In many applications it is important to measure the direction of arrival of a radio wave. This determination of such a "line of bearing" is most often accomplished by using a set of spatially separated elements and properly combining their separate receptions.

According to the book entitled "Antenna Engineering Handbook, 3$^{rd}$ Ed.," edited by Richard C. Johnson, published by McGraw-Hill, Inc. in 1993, pp. 24–8, there are few antenna configurations capable of effective performance in the very low frequency (VLF) range (i.e., 10 KHz to 300 KHz). The most common types are the base-insulated monopole, the top-loaded monopole, the T-antenna, and the inverted-L antenna. The performance of each of these antennas depends on their effective height and volume. In applications where size matters, such antennas may not be practical. In applications where performance matters, these antennas may not perform adequately in the extremely low frequency (ELF) range (i.e., 1 Hz to 10 KHz).

U.S. Pat. No. 3,953,799, entitled "BROADBAND VLF LOOP ANTENNA," discloses a single loop antenna that includes a negative reactance circuit. U.S. Pat. No. 3,953,799 does not disclose the antenna of the present invention and may not operate in the ELF range. U.S. Pat. No. 3,953,799 is hereby incorporated by reference into the specification of the present invention.

U.S. Pat. No. 5,357,253, entitled "SYSTEM AND METHOD FOR EARTH PROBING WITH DEEP SUBSURFACE PENETRATION USING LOW FREQUENCY ELECTROMAGNETIC SIGNALS," discloses a single loop antenna for receiving a signal, an amplifier for amplifying the signal, and a combiner for combining the amplified signal with an amplified signal received by a second single loop antenna which is used as a reference. U.S. Pat. No. 5,357,253 does not disclose the antenna of the present invention and may not operate in the ELF range. U.S. Pat. No. 5,357,253 is hereby incorporated by reference into the specification of the present invention.

U.S. Pat. No. 5,840,024, entitled "ENDOSCOPE FORM DETECTING APPARATUS IN WHICH COIL IS FIXEDLY MOUNTED BY INSULATING MEMBER SO THAT IT IS NOT DEFORMED WITHIN ENDOSCOPE," discloses the use of a three-axes sense coil, but does not disclose the antenna of the present invention and may not operate in the ELF range. U.S. Pat. No. 5,840,024 is hereby incorporated by reference into the specification of the present invention.

U.S. Pat. No. 6,084,513, entitled "METHOD AND APPARATUS FOR TRACKING A PATIENT," discloses a device that uses a loop antenna in each of three axes, but does not disclose the antenna of the present invention and may not operate in the ELF range. U.S. Pat. No. 6,084,513 is hereby incorporated by reference into the specification of the present invention.

U.S. Pat. No. 6,095,260, entitled "SYSTEM, ARRANGEMENT AND ASSOCIATED METHODS FOR TRACKING AND/OR GUIDING AN UNDERGROUND BORING TOOL," THE USE OF A CUBIC ANTENNA," discloses the use of a cubic antenna constructed using six circuit boards with spiral conductive patterns formed thereon, but does not disclose the antenna of the present invention and may not operate in the ELF range. U.S. Pat. No. 6,095,260 is hereby incorporated by reference into the specification of the present invention.

SUMMARY OF THE INVENTION

It is an object of the present invention to receive a signal with maximum sensitivity.

It is another object of the present invention to receive a signal with maximum sensitivity, where the signal is either a magnetic signal or an electromagnetic signal.

It is another object of the present invention to receive a signal in a compact area.

It is another object of the present invention to determining the line of bearing of a received signal.

It is another object of the present invention to receive a signal with maximum sensitivity by a device with broad instantaneous bandwidth.

The present invention is an antenna that includes a cubic core, having a first axis, a second axis, and a third axis. A first conductor is wound around the first axis of the core a user-definable number of times, or turns, forming a first coil.

A first amplifier is connected to the first coil.

A first dielectric layer surrounds the first coil.

A first electrical shield surrounds the first dielectric layer.

A second dielectric layer surrounds the first electrical shield.

A second conductor is wound around the second dielectric layer in the second axis of the core, forming a second coil.

A second amplifier is connected to the second coil. The second conductor is wound around the second dielectric layer a number of times so that an output voltage of the second amplifier is the same as an output voltage of the first amplifier while under the same signal conditions.

A third dielectric layer surrounds the second coil.

A second electrical shield surrounds the third dielectric layer.

A fourth dielectric layer surrounds the second electrical shield.

A third conductor is wound around the fourth dielectric layer in the third axis, forming a third coil.

A third amplifier is connected to the third coil. The third conductor is wound around the fourth dielectric layer a number of times so that an output voltage of the third amplifier is the same as the output voltages of the first and second amplifiers while under the same signal conditions.

A fifth dielectric layer surrounds the third coil.

A third electrical shield surrounds the fifth dielectric layer.

A sixth dielectric layer surrounds the third electrical shield.

A fifth electrical shield is wrapped around the sixth dielectric layer.

A first anti-aliasing filter is connected to the first amplifier.

A first A/D converter is connected to the first ant-aliasing filter.

A second anti-aliasing filter is connected to the second amplifier.

A second A/D converter is connected to the second ant-aliasing filter.

A third anti-aliasing filter is connected to the third amplifier.

A third A/D converter is connected to the third ant-aliasing filter.

The first, second, and third anti-aliasing filters are connected to a multiplexer.

DETAILED DESCRIPTION

The present invention is a compact, transportable antenna that may be configured to receive magnetic and electromagnetic signals in the extremely low frequency (ELF) range (i.e., 1 HZ to 10 KHz), the very low frequency range (VLF) (i.e., 10 KHz to 300 KHz), and the high frequency (HF) range (i.e., 2 MHZ to 16 MHz) or higher.

Figure 1:
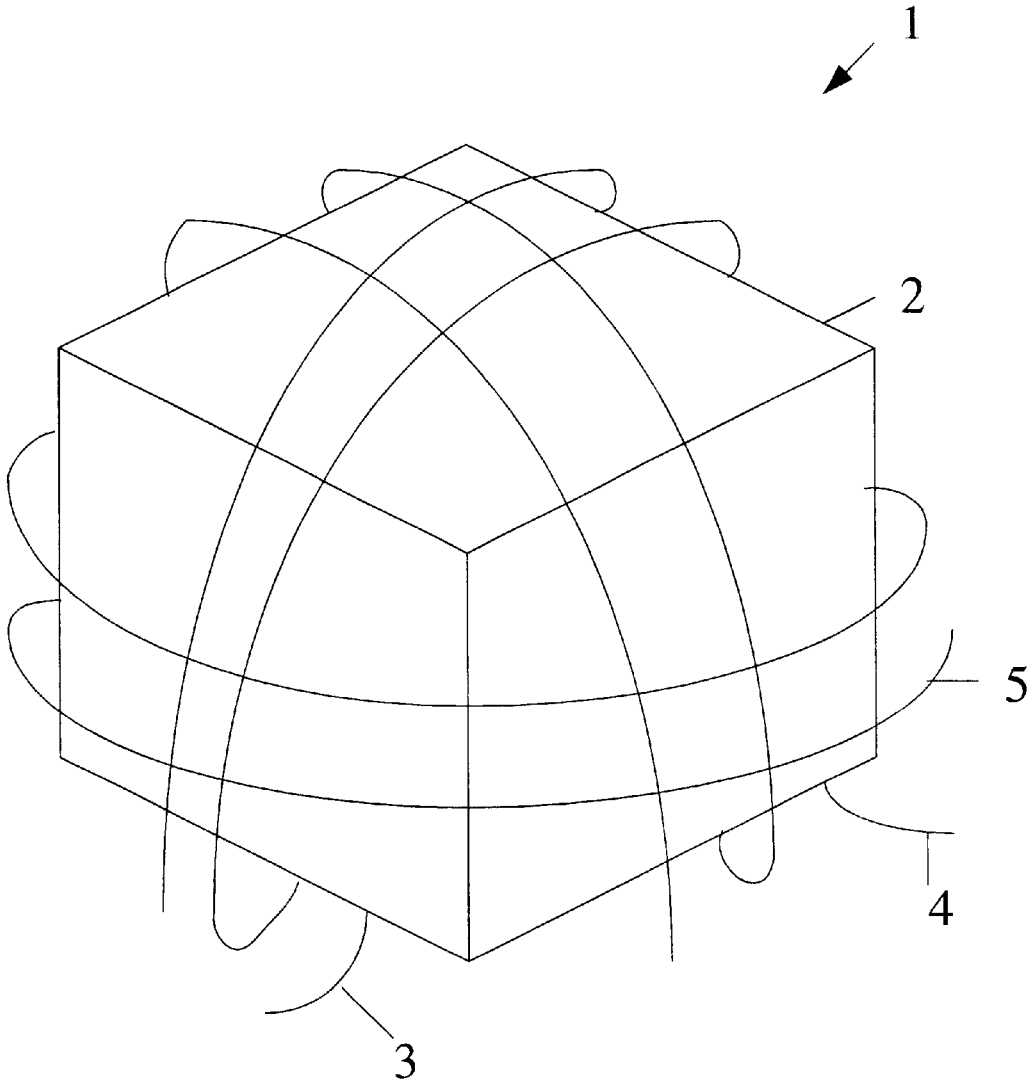
FIG. 1 is a simplified perspective view of the antenna.

FIG. 1 is a simplified perspective view of the antenna 1 that shows its basic construction without obscuring detail. However, the details described below are relied upon for the novelty of the present invention. The antenna 1 includes a core 2 around which is wound a first conductor 3, a second conductor 4, and a third conductor 5. A conductor so wound is commonly referred to as a coil. In the preferred embodiment, the core 2 is a cube having three axes, where the axes are orthogonal to each other. However, other configurations of the core 2 are possible (e.g., a cube where the axes are not orthogonal to each other).

Figure 2:
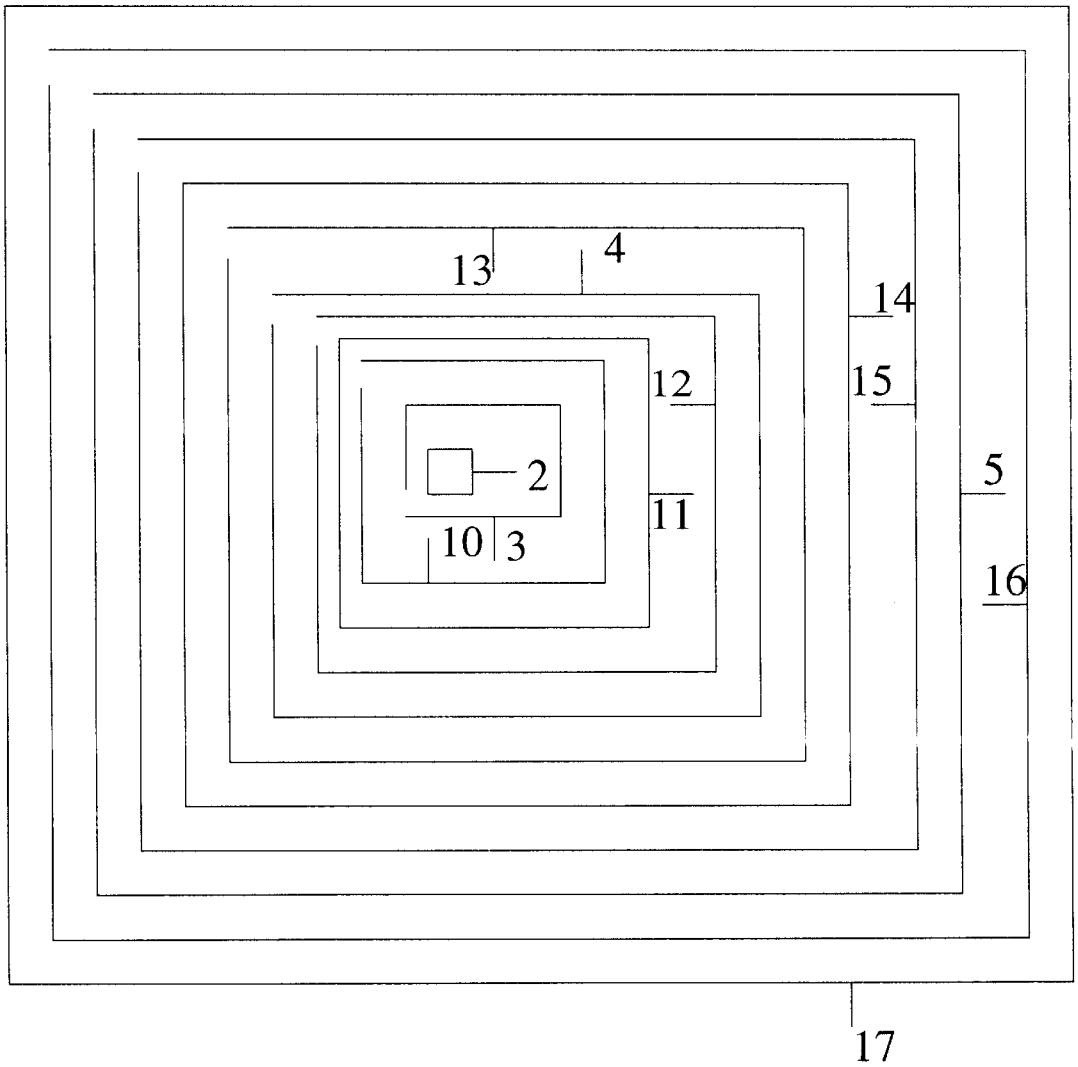
FIG. 2 is a quasi cross-sectional view of the antenna.

FIG. 2 is a quasi cross-sectional view of the antenna 1. To better convey the structure of the antenna 1, the first, second, and third conductors 3, 4, 5 are shown wound around the same axis of the core 2. In reality, the first, second, and third conductors 3, 4, 5 are wound around different axes of the core 2.

The core 2 is electrically inert and is, preferably, made of foam. The size of core 2 is a design factor which is discussed in greater detail below. The core 2 may include a cavity for housing electronics described below that are connected to the conductors 3, 4, 5 for processing signals received by the conductors 3, 4, 5. The cavity may be at the center of the core 2 to maintain concentricity and eliminate any bias due to an offset. The core 2 may include a hollow shaft on each of two sides of the cavity to the surface of the core 2 for increasing air circulation around the electronics and, therefore, increase the power dissipation capability of the electronics.

The first conductor 3 is wound around one of the three axes (i.e., the x-axis, the y-axis, or the z-axis) of the core 2 a user-definable number of times. The product of the number of times, or turns, the first conductor 3 is wrapped around the core and the area of a turn of the first conductor 3 determines the sensitivity of the antenna 1. The area of a turn of the first conductor 3 is the product of the length and width of the cross-section of the core 2 around which the first conductor 3 is wound, where the cross-section of the core 2 is along the same axes as the first conductor 3 is wound. The first conductor 3 is wound around the first axis (e.g., z-axis) of the core 2 a user-definable number of times such that atmospheric electrical noise picked up by the first conductor 3 produces a voltage at the output of a first amplifier 31 described below to be greater than the noise voltage of the first amplifier 31. In the preferred embodiments for ELF, VLF, and HF applications, the number of turns of the first conductor 3 where the core 2 is a square with 16 inch sides is around 300, around 70, and around 10, respectively. If the size of the core 2 where larger, or smaller, the number of turns would be fewer, or greater, to attain the same antenna sensitivity. The turns of the first conductor 3 are equally spaced so that the self-resonant frequency of the first conductor 3 is greater than the maximum frequency of interest to be received by the antenna 1.

A first dielectric layer 10 surrounds the first conductor 3 to insulate it from the first electrical shield described below. There is at least one opening in the first dielectric layer 10 to allow the electronics of FIG. 3 described below to pass there through. The material of the first dielectric layer 10 is any suitable electrically-inert material.

A first electrical shield 11 surrounds the first dielectric layer 10. There is at least one opening in the first electrical shield 11 to allow the electronics of FIG. 3 described below to pass there through. In the preferred embodiment, the first electrical shield 11 is metal (e.g., copper), but any suitable material for minimizing electrical interference will suffice. The first electrical shield 11 provides a capacitive shield between the first conductor 3 and the second conductor 4.

A second dielectric layer 12 surrounds the first electrical shield 11. There is at least one opening in the second dielectric layer 12 to allow the electronics of FIG. 3 described below to pass there through. The material of the second dielectric layer 12 is any suitable electrically-inert material.

Figure 3:
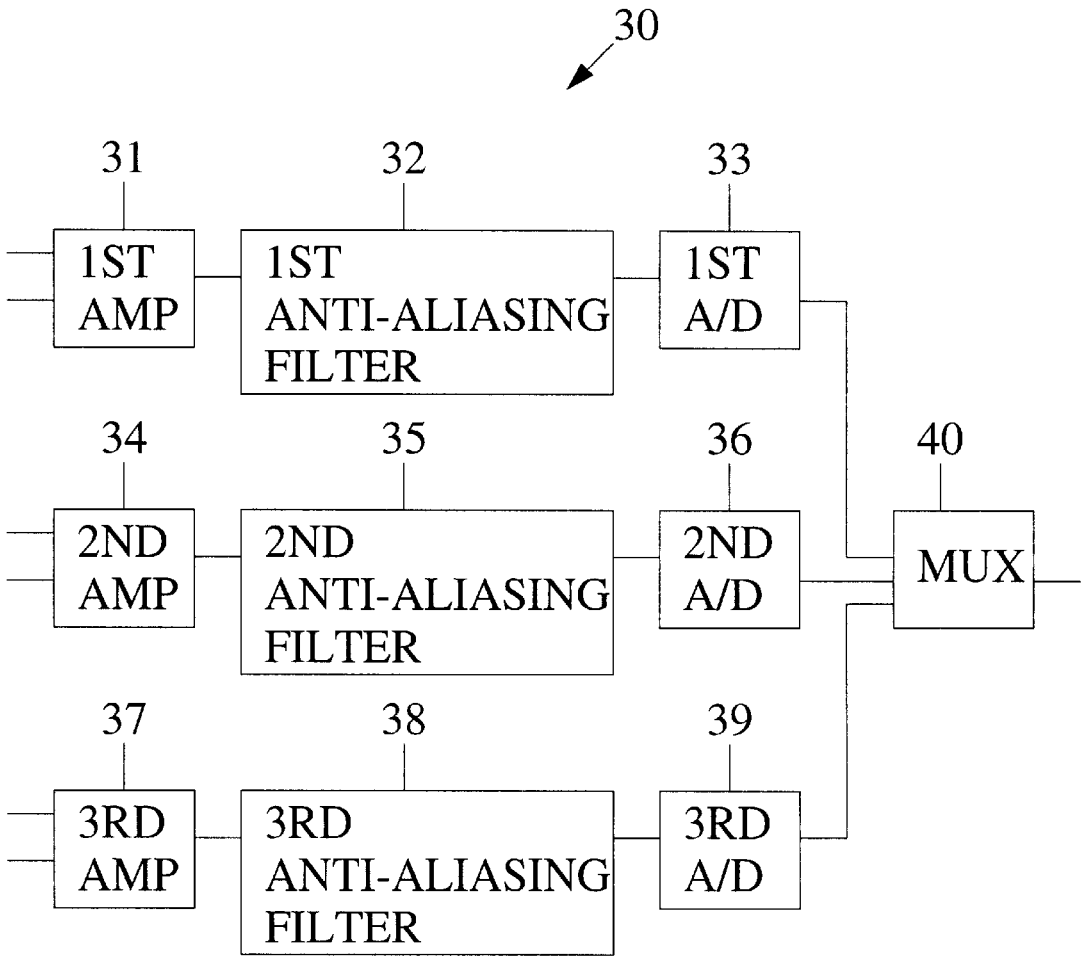
FIG. 3 is a block diagram of electronics connected to the antenna.

The second conductor 4 is wound around the second dielectric layer 12 a user definable number of times in a second axis (e.g., x-axis) of the core 2. In the preferred embodiment, the second conductor 4 is orthogonal to, and concentric with, the first conductor 3. However, non-orthogonal and non-concentric arrangements are possible. A second amplifier 32, described below and in FIG. 3, is connected to the second conductor 4. The number of turns of the second conductor 4 is such that a signal produced by the second amplifier 32 is identical to that produced by the first amplifier 31 connected to the first conductor 3. The number of turns of the second conductor 4 may be different than that of the first conductor 3. In the preferred embodiment, the turns of the second conductor 4 are equally spaced so that its resonant frequency is greater than the maximum frequency of a signal of interest received by the antenna 1.

The first, second, and third conductors 3, 4, 5 must each be designed and constructed to have a self-resonant frequency above the highest frequency of interest of a received signal. In the preferred embodiment for an ELF antenna, the first, second, and third conductors 3, 4, 5, must each be designed and constructed to have a self-resonant frequency above 10 KHz. In the preferred embodiment for a VLF antenna, the first, second, and third conductors 3, 4, 5, must each be designed and constructed to have a self-resonant frequency above 300 KHz. In the preferred embodiment for an HF antenna, the first, second, and third conductors 3, 4, 5, must each be designed and constructed to have a self-resonant frequency above 16 MHz. With the first, second, and third conductors designed so, the output voltage vs. frequency for each conductor increases linearly up to its self-resonant frequency.

A third dielectric layer 13 surrounds the second conductor 4. At least one opening is in the third dielectric layer 13 to allow the electronics of FIG. 3 described below to pass there through. The material of the third dielectric layer 13 is any suitable electrically-inert material.

A second electrical shield 14 surrounds the third dielectric layer 13. At least one opening is in the second electrical shield 14 to allow the electronics of FIG. 3 described below to pass there through. In the preferred embodiment, the first electrical shield 11 is metal (e.g., copper), but any suitable material for minimizing electrical interference will suffice. The second electrical shield 14 provides a capacitive shield between the second conductor 4 and the third conductor 5.

A fourth dielectric layer 15 surrounds the second electrical shield 14. At least one opening is in the fourth dielectric layer 15 to allow the electronics of FIG. 3 described below to pass there through. The material of the fourth dielectric layer 15 is any suitable electrically-inert material.

The third conductor 5 is wrapped around the fourth dielectric layer 15 a number of times in a third axis (e.g., y-axis) of the core 2. A third amplifier 37 described below and in FIG. 3 is connected to the third conductor 5. The number of turns of the third conductor 5 is such that the signal produced by the third amplifier 37 is identical to that produced by the first amplifier 31 and the second amplifier 34. Therefore, the number of turns of the third conductor 5 may be different than that of the first conductor 3 and the second conductor 4. In the preferred embodiment, the turns of the third conductor 5 are equally spaced so its self-resonant frequency is greater than the maximum frequency of interest received by the antenna 1.

A fifth dielectric layer 16 surrounds the third conductor 5. At least one opening is in the fifth dielectric layer 16 to allow the electronics of FIG. 3 described below to pass there through. The material of the fifth dielectric layer 16 is any suitable electrically-inert material.

A third electrical shield 17 of conductive material is wrapped around the fifth dielectric layer 16, where the ends of the third electrical shield 17 are connected together to form a cylinder of conductive material around the fifth dielectric layer 16. In the preferred embodiment, the third electrical shield 17 is metal (e.g., copper), but any suitable conductive material will suffice. The resistance of the third electrical shield 17 is a design factor that is empirically arrived at for attenuating a received signal whose frequency is higher than the maximum frequency of interest for the antenna 1 so that such frequencies are dampened. In the preferred embodiment of an ELF antenna, the third electrical shield 17 is a 0.004 inch thick sheet of stainless steel. Such a third electrical shield 17 attenuates a signal with a frequency greater than 20 KHz. In the preferred embodiment of a VLF antenna, the third electrical shield 17 is a 4000 Angstrom thick sheet of nickel. Such a third electrical shield 17 attenuates a signal with a frequency greater than 600 KHz. The third electrical shield 17 includes at least one hole through which the electronics of FIG. 3 described below may pass. In an alternate embodiment, the third electrical shield 17 may be realized by a user-definable number of conductive wire loops.

FIG. 3 is a block diagram of the electronics 30 which are connected to the first, second, and third conductors 3, 4, 5. The electronics 30 may be contained in a shielded container (e.g., a metal container) having at least one chamber for minimizing interference with the electronics 30. In the preferred embodiment, the container has three chambers, one per conductor channel. In the preferred embodiment, the electronics associated with a particular conductor are placed in its own chamber. The container (not shown) may then be placed in a cavity at the center of the core 2.

A first amplifier 31 has two inputs for being connected to the ends of the first conductor 3. The output of the first amplifier 31 is connected to the input of a first anti-aliasing filter 32. In the preferred embodiment, the first anti-aliasing filter 32 is a lowpass filter. The output of the first anti-aliasing filter 32 is connected to the input of a first analog-to-digital (A/D) converter 33.

A second amplifier 32 has two inputs for being connected to the two ends of the second conductor 4. The output of the second amplifier 34 is connected to the input of a second anti-aliasing filter 35. In the preferred embodiment, the second anti-aliasing filter 35 is a low-pass filter. The output of the second anti-aliasing filter 35 is connected to the input of a second analog-to-digital converter 36.

A third amplifier 37 has two inputs for being connected to the two ends of the third conductor 5. The output of the third amplifier 37 is connected to the input of a third anti-aliasing filter 39. In the preferred embodiment, the third anti-aliasing filter 38 is a low-pass filter. The output of the third anti-aliasing filter 38 is connected to the input of a third analog-to-digital converter 39.

The outputs of the first, second and third analog-to-digital converters 33, 36, 39 are connected to the inputs of a multiplexer 40. The output of the multiplexer 40 may be transmitted via a cable transmission system, an optical transmission system, or a broadcast transmission system.

For an ELF antenna, the first, second, and third analog-to-digital converters 33, 36, 39 may each be a 16 bit analog-to-digital converter sampled at greater than 25 k samples per second. For an HF antenna, the first, second, and third analog-to-digital converters 33, 36, 39 may each be a 16-bit analog-to-digital converter sampled at greater than 50 M samples per second. Any other suitable analog-to-digital converter may be used for the first, second, and third analog-to-digital converters 33, 36, 39.

Figure 4:
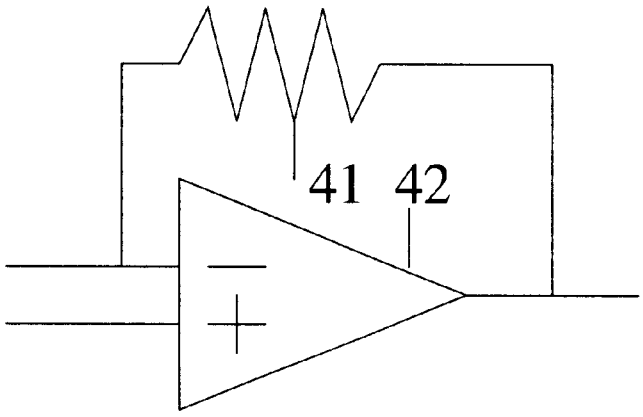
FIG. 4 is a schematic of a preferred amplifier.

FIG. 4 is a first configuration (i.e., a negative-feedback amplifier) into which each of the first, second, and third amplifiers 31, 34, 37 may be arranged. A negative feedback amplifier configuration is realized by connecting a resistor 41 between the output and the negative-input of an operational amplifier 42.

Figure 5:
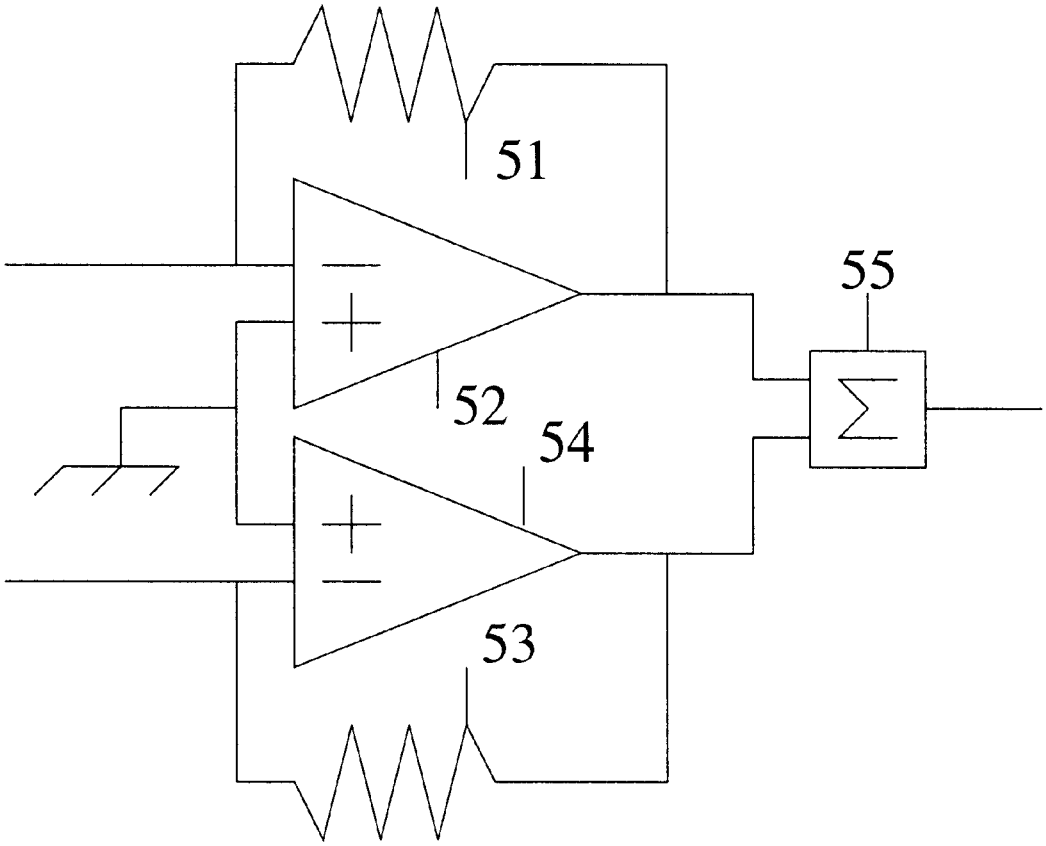
FIG. 5 is a schematic of an alternate amplifier.

FIG. 5 is the preferred configuration (i.e., a differential-input, negative-feedback amplifier) into which each of the first, second, and third amplifiers 31, 34, 37 may be arranged. A differential-input, negative-feedback amplifier configuration is realized by connecting a first resistor 51 between the output and the negative-input of a first operational amplifier 52, connecting a second resistor 53 between the output and the negative-input of a second operational amplifier 54, connecting the positive-inputs of the first and second operational amplifiers 52, 54 to ground, and connecting the outputs of the first and second operational amplifiers 52, 54 to a device 55 for summing the outputs of the first and second operational amplifiers 52, 54. Operational amplifiers and summing devices are commercially available.

The first, second, and third amplifiers 31, 34, 37 must be configured to have a gain that is proportional to 1/f, whereof is the frequency of interest of the received signal. Such a gain is realized by insuring that the resistance of the conductor (i.e., the first, second, or third conductor 3, 4, 5) connected to the amplifier (i.e., the first, second, or third amplifier 31, 34, 37, respectively) has the resistance of the conductor is less than the inductive reactance of the conductor.

The source of electrical power for the electrical components of the electronics 30 may be alternating-current (AC) power, direct-current (DC) power, solar power, or any combination thereof.

What is claimed is:

1. An antenna, comprising:

(a) a cubic core, having a first axis, a second axis, and a third axis;

(b) a first conductor, where the first conductor is wound around the first axis of the core a user-definable number of times such that atmospheric noise picked-up by the first conductor causes a voltage generated by an amplifier to be greater than a noise voltage of the amplifier, where the windings of the first conductor are equally spaced so that a self-resonant frequency of the first conductor is greater than a maximum frequency of interest to be received, and where a resistance of the first conductor is less than an inductive reactance of the first conductor;

(c) a first dielectric layer surrounding the first conductor, having at least one-opening therein;

(d) a first electrical shield surrounding the first dielectric layer, having at least one-opening therein;

(e) a second dielectric layer surrounding the first electrical shield, having at least one-opening therein;

(f) a second conductor, where the second conductor is wound around the second dielectric layer a user-definable number of times in the second axis of the core such that a voltage produced there from is identical to that produced by the first conductor, where the windings of the second conductor are equally spaced so that the self-resonant frequency of the second conductor is greater than the maximum frequency of interest to be received, and where a resistance of the second conductor is less than an inductive reactance of the second conductor;

(g) a third dielectric layer surrounding the second conductor, having at least one-opening therein;

(h) a second electrical shield surrounding the third dielectric layer, having at least one-opening therein;

(i) a fourth dielectric layer surrounding the second electrical shield, having at least one-opening therein;

(j) a third conductor, where the third conductor is wound around the fourth dielectric layer a user-definable number of times in the third axis of the core such that a voltage produced therefrom is identical to that produced by the first conductor, where the windings of the third conductor are equally spaced so that the resonant frequency of the third conductor is greater than the maximum frequency of interest to be received, and where a resistance of the third conductor is less than an inductive reactance of the third conductor;

(k) a fifth dielectric layer surrounding the third conductor, having at least one-opening therein; and (l) a third electrical shield surrounding the fifth dielectric layer that dampens received frequencies above the highest frequency of interest.

2. The device of claim 1, further including:

(a) a first amplifier, having a first input connected to a first end of the first conductor, having a second input connected to a second end of the first conductor, and having an output;

(b) a first anti-aliasing filter, having an input connected to the output of the first amplifier, and having an output;

(c) a first analog-to-digital converter, having an input connected to the output of the first anti-aliasing filter, and having an output;

(d) a second amplifier, having a first input connected to a first end of the second conductor, having a second input connected to a second end of the second conductor, and having an output;

(e) a second anti-aliasing filter, having an input connected to the output of the second amplifier, and having an output;

(f) a second analog-to-digital converter, having an input connected to the output of the second anti-aliasing filter, and having an output;

(g) a third amplifier, having a first input connected to a first end of the third conductor, having a second input connected to a second end of the third conductor, and having an output;

(h) a third anti-aliasing filter, having an input connected to the output of the third amplifier, and having an output;

(i) a third analog-to-digital converter, having an input connected to the output of the third anti-aliasing filter, and having an output; and (j) a multiplexer, having a first input connected to the output of the first analog-to-digital converter, having a second input connected to the output of the second analog-to-digital converter, having a third input connected to the output of the third analog-to-digital converter, and having an output.

3. The device of claim 2, wherein the core is comprised of a core with a cavity therein.

4. The device of claim 3, further including a container in the cavity of the core for housing the first amplifier, the first anti-aliasing filter, the first analog-to-digital converter, the second amplifier, the second anti-aliasing filter, the second analog-to-digital converter, the third amplifier, the third anti-aliasing filter, the third analog-to-digital converter, and the multiplexer, for shielding any interference there between.

5. The device of claim 4, wherein said container is cube-shaped.

6. The device of claim 2 wherein the first amplifier, the second amplifier, and the third amplifier are each comprised of:

(a) an operational amplifier, having a negative-input, having a positive input, and having an output; and (b) a resistor connected between the output and the negative input of the operational amplifier.

7. The device of claim 2, wherein the first amplifier, the second amplifier, and the third amplifier are each comprised of:

(a) a first operational amplifier, having a negative-input, having a positive input connected to a ground potential, and having an output;

(b) a first resistor connected between the output and the negative input of the first operational amplifier;

(c) a second operational amplifier, having a negative-input, having a positive input connected to the positive input of the first operational amplifier, and having an output; and (d) a second resistor connected between the output and the negative input of the second operational amplifier.

8. The device of claim 2, wherein the first anti-aliasing filter, the second anti-aliasing filter, and the third anti-aliasing filter are each a low-pass filter.

9. The device of claim 2, wherein the output of the multiplexer is connected to a transmission system, where the transmission system is selected from the group of transmission systems consisting of a cable transmission system, optical transmission system, broadcast transmission system.

10. The device of claim 2, wherein the source of electrical power is selected from the group of sources of electrical power consisting of AC power, DC power, solar power, and any combination thereof.

11. The device of claim 1, where the first conductor is wound around the core a user-definable number of times, where the number is selected from the group of numbers consisting of around 300, around 70, and around 10, where the core is square, and where each side of the core is 16 inches long.

12. The device of claim 1, wherein the core is comprised of an electrically-inert material.

13. The device of claim 12, wherein the core is comprised of foam.

* * * * *